US005645443A

United States Patent [19]

Schaller

[11] Patent Number: 5,645,443

[45] Date of Patent: Jul. 8, 1997

[54] POTENTIAL DISTRIBUTOR ESPECIALLY FOR FUSE BOXES OF MOTOR VEHICLES

[75] Inventor: Thomas Schaller, Wuppertal, Germany

[73] Assignee: Delphi Automotive Systems Deutschland GmbH, Germany

[21] Appl. No.: 423,795

[22] Filed: Apr. 18, 1995

[30] Foreign Application Priority Data

Apr. 21, 1994 [DE] Germany ..... 44 13 880.6

[51] Int. Cl.[6] ..... H01R 4/60

[52] U.S. Cl. ..... 439/212; 439/949

[58] Field of Search ..... 439/212, 885, 439/949

[56] References Cited

FOREIGN PATENT DOCUMENTS 2109583 5/1972 France .
2523164 12/1976 Germany .
3023341 1/1982 Germany .
3048451 7/1982 Germany .
4109013 1/1992 Germany .

*Primary Examiner*—Gary F. Paumen
*Assistant Examiner*—Daniel Wittels
*Attorney, Agent, or Firm*—Reising, Ethington, Barnard & Perry

[57] ABSTRACT

A potential distributor is disclosed which comprises a two-layer, flat base rail having a plurality of flat plug tongues which project from the base rail and are oriented transversely with respect to the course of the rail. The two layers of the base rail are made from two folded limbs of an integral strip which are pressed flat against one another. Catch parts on the outer edges of the two folded limb located in longitudinally staggered relationship are used to produce a third layer of sheet metal material in the base rail. Extensions of the edge parts are bent and produce the flat plug tongues.

12 Claims, 3 Drawing Sheets

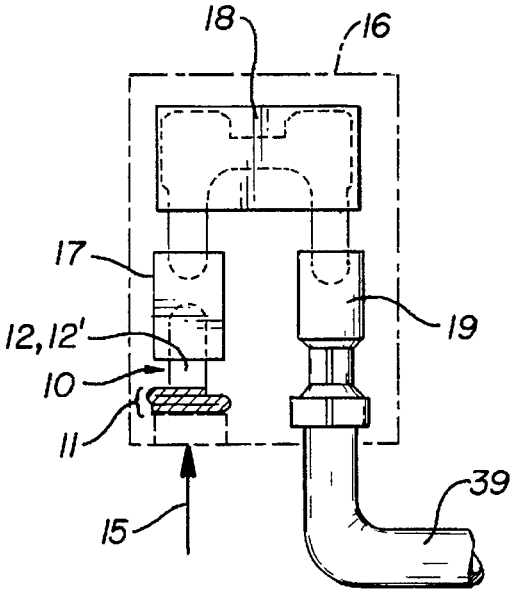
FIG-1
FIG-6
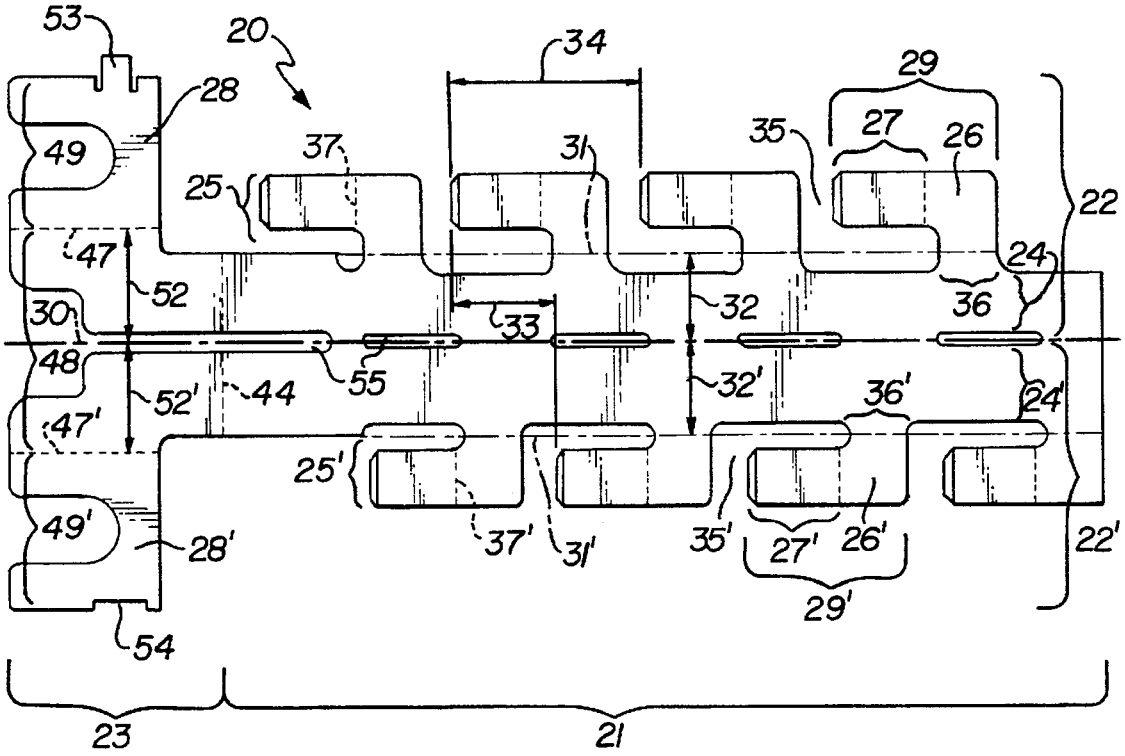

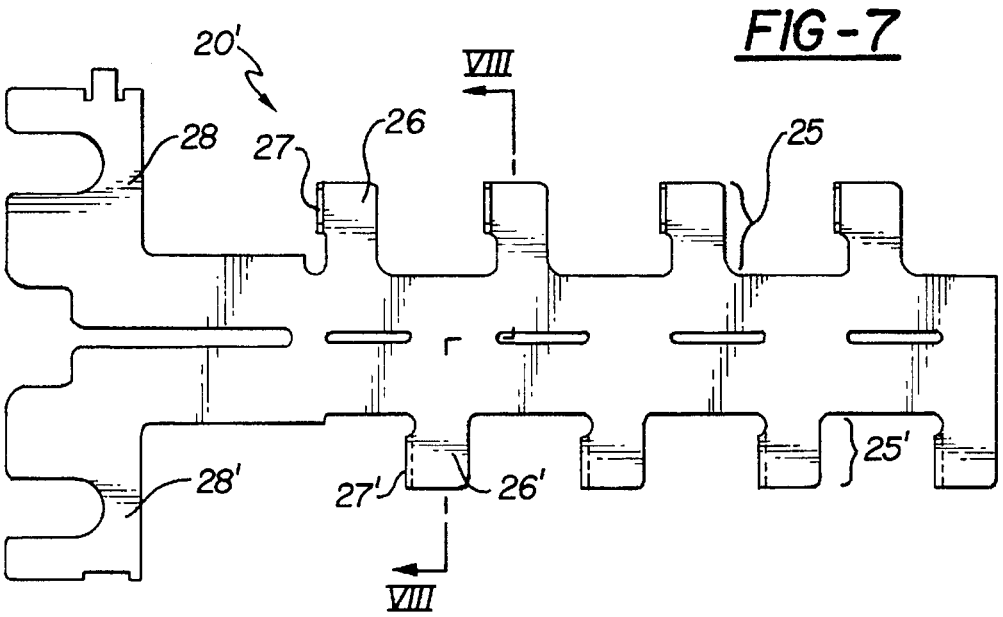
FIG-7
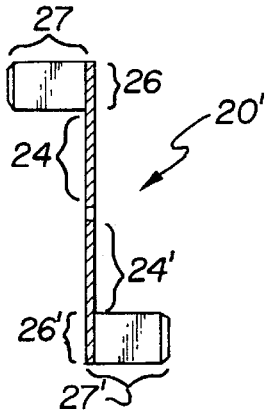
FIG-8
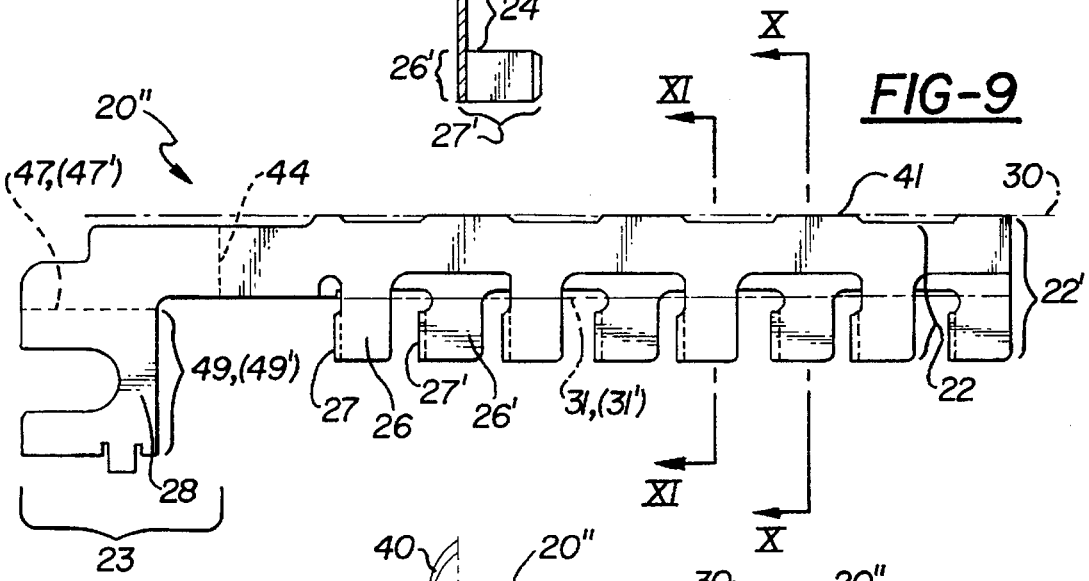
FIG-9
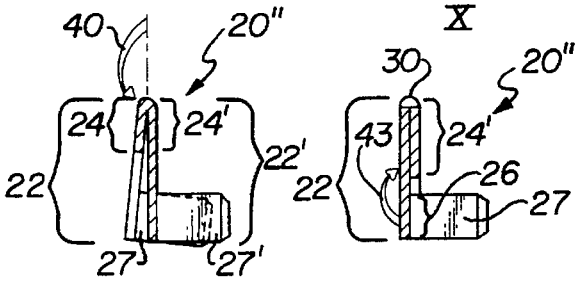
FIG-10
FIG-11

POTENTIAL DISTRIBUTOR ESPECIALLY FOR FUSE BOXES OF MOTOR VEHICLES

FIELD OF THE INVENTION

The invention relates to a potential distributor of the type having flat plug tongues which project from a base rail and are produced from sheet-metal material by stamping and bending processes.

BACKGROUND OF THE INVENTION

In order to arrange the flat plug tongues in a row on the base rail in as close a sequence as possible, two mutually differently profiled sheet-metal strips were used in the case of the known potential distributor of this type, which sheet-metal strips have the stamped and bent flat plug tongues in a mutually alternating sequence on the same longitudinal edge. Once the stamping and bending have been completed, the two strips are placed one on top of the other and are held together by brackets which are integrally formed on the bottom strip. These two strips which are placed one on top of the other produce a double-layer base rail from which the flat plug tongues originate in an alternating sequence, either from the upper layer or from the lower layer. The provision of different bending tools for the two strip parts, the stamping and bending processes which have to be carried out separately and, finally, the assembly of the two stamped products are cumbersome and time consuming. Despite the two strip parts being bracketed together, the two layers of the base rail do not make reliable electrical contact. In the event of movement and vibration, as necessarily occur when used in motor vehicles, undesirable spark flashovers can occur between the two layers of the base rail.

In the case of a contact piece having flat tongues (DE 41 09 013 A1), which has no two-layer flat base rail, it is known to proceed from a common sheet-metal strip on which the flat plug tongues are cut out in the two mutually opposite strip edges. The central zone of the common strip is folded to produce a U-shaped channel on whose two channel limbs the flat plug tongues are alternately integrally formed and are bent over the U-channel opening along an inclined folding line. Located on the respectively opposite U-channel limb is an edge cutout into which a lug, which is integrally formed on the flat plug tongues, must be clipped. These cumbersome bending and engagement processes are susceptible to defects and do not ensure that the flat plug tongues have a stable, correct position. Spark flashovers can also occur here, as a result of vibration. The U-channel rail permits only a limited electrical load capacity.

Single-layer potential distributors are known, in the case of which the flat plug tongues are produced by bending stamped-out lugs (DE-OS 30 23 341; DE-PS 30 48 451). In this case, the projecting flat plug tongues must be arranged at a relatively large distance apart. This does not permit compact construction. The single-layer nature of the base rail allows only a low electrical and mechanical load capacity.

It is known for the conductive contacts in the insulation housing of a contact strip to be produced from a U-shaped or double-U-shaped sheet-metal strip on whose two longitudinal edges mutually opposite attachments are stamped out which, after they have been bent, produce flat plug tongues (DE-OS 25 23 164). An extended base rail is not provided here. Finally, it is known for contact strips to be produced from a sheet-metal strip twisted into an S-shape, where individual limbs are extended on one side in order to produce projecting flat plug tongues there (FR-OS 21 09 583). A flat base rail is not provided here, for which reason the problem of being able to arrange flat plug tongues in a close sequence in such a linear structure does not arise.

SUMMARY OF THE INVENTION

According to the invention, separate production of two strip pieces and their subsequent time-consuming assembly are avoided. Nevertheless, the flat plug tongues which project from the multilayer base rail can be arranged in a row in a close sequence. The invention is based on an integral original strip, where the two layers of the base rail are produced from the two folded limbs which are produced when folded longitudinally. The flat plug tongues are in this case produced from extensions on the two mutually opposite strip edges, which comprise profiled edge parts which are arranged alternately with respect to one another. In consequence, only a single stamping and bending tool is required to produce the potential distributor according to the invention, and the potential distributor can be constructed with a significantly narrower base rail for a predetermined size. The folded limbs, which are pressed flat onto one another, are in this case held together by those edge parts of the original strip which, for their part, are folded round on two parallel folding lines, as a result of which even a third material layer is produced in certain sections of the base rail. The third layer enlarges the rail cross-section and allows the potential distributor according to the invention to have a high load capacity.

The edge parts on both sides of the original strip, which produce the flat plug tongues, have the further function in the case of the invention of ensuring that the two folded limbs press against one another over a large area.

In consequence, good contact is made between the two base rail layers, which contact also withstands any movements or vibration in a motor vehicle or the like. Both the common longitudinal folding line between the two folded limbs and the third material layer of the base rail contribute to good mechanical stiffness of the potential distributor according to the invention. The greater stiffness simplifies the installation of the potential distributor in a fuse box or the like.

An exemplary embodiment of the invention is illustrated in the drawings, in which:

DESCRIPTION OF THE DRAWINGS

FIG. 1 shows the use of the potential distributor in a fuse box of motor vehicles, in a schematic cross-section;

FIG. 6 shows a plan view of an original strip which has been stamped from sheet-metal material and from which the complete potential distributor can be produced by folding processes, FIG. 7 shows a first intermediate folded product of the original strip after completion of the first folding process, in a plan view corresponding to FIG. 6;

FIG. 8 shows a cross-sectional view through the first intermediate folded product, along the section line VIII—VIII indicated in FIG. 7;

FIG. 9 shows a second intermediate folded product in a plan view corresponding to FIG. 7, after a second folding process has been carried out, which has then to be followed by further folding processes before the final folded product according to FIG. 3 is achieved;

FIG. 10 shows a cross-section through the second intermediate folded product along the section line X—X indicated in FIG. 9, although the two fold layers are illustrated, for clarity, with a small folding angle still between them; and FIG. 11 shows a further cross-section through the second intermediate folded product, along the section line XI—XI indicated in FIG. 9.

BEST MODE FOR CARRYING OUT THE INVENTION

Figure 2:
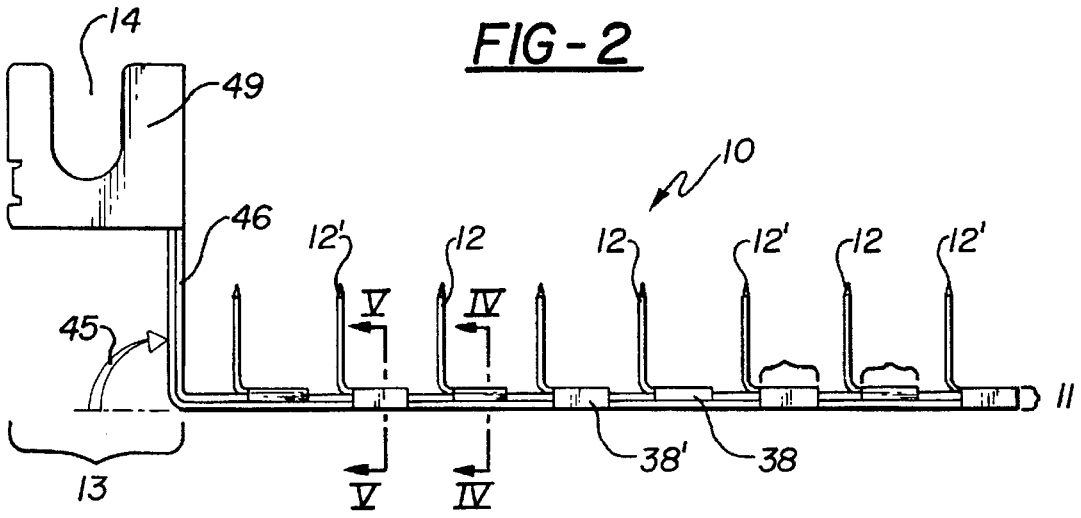
FIGS. 2 and 3 show the elevation view and plan view of the potential distributor used in FIG. 1.

The potential distributor 10 which is shown in FIGS. 2 through 5 comprises a multilayer base rail 11 from which a family of flat plug tongues 12, 12' project vertically. In addition, the base rail 11 is provided with an end piece 13 which is bent a plurality of times and has a cutout 14, a hole or the like for an electrical connection. Although such an electrical connection cannot be seen in the application in FIG. 1 because of the course of the cut, it is indicated there by an arrow 15.

FIG. 1 shows the use of this potential distributor 10 in a fuse box for motor vehicles, which may comprise two housing halves and is indicated there in dashed-dotted form by its outlines. The potential distributor 10 is fixed in the interior of the fuse box. A supply lead coming from the motor vehicle battery is used as the electrical connection 15. A contact strip 17, which is equipped with a family of sleeves, is plugged onto the flat plug tongues 12, 12. The individual sleeves in this contact strip 17 make a plug connection with one plug limb of this flat fuse 18. The other plug limb of this flat fuse 18 is electrically connected via individual flat plug sleeves 19 to a lead 39, which leads to a load.

During the production of the potential distributor 10, an integral original strip 20, which can be seen in FIG. 6, is initially cut out of a sheet-metal material by means of special stamping cuts. The strip 20 is formed in stages by a plurality of special folds to produce the end product which can be seen in FIGS. 2 to 5. The cutting and multiple folding can be produced with a common tool, by pushing the sheet-metal material through a step by step. As can be seen in FIG. 6, this original strip 20 has the following special outline profile.

The original strip 20 can be broken down in the longitudinal direction into a main section 21, which is used for the construction of the base rail 11 with its flat plug tongues 12, 12', and an end section 23, which is intended for the formation of the end piece 13. As will be explained in more detail with reference to FIGS. 9 through 11, the original strip is folded longitudinally along a longitudinal folding line 30, which is arranged in its longitudinal center, as indicated by a dashed-dotted line in FIG. 6 and breaks the original strip 20 into two strip halves 22, 22', which can be folded with respect to one another. The longitudinal folding line 30 is at the same time an axis of symmetry for the outline profile or contour of the original strip 20. However, these two strip halves 22, 22' have a mutually different symmetry with respect to the longitudinal folding line 30, in certain sections. The end section 23 is constructed with its end piece parts 28, 28', which are located on both sides of the longitudinal folding line 30, essentially symmetrical in terms of folding. However, in the main section 21 of the original strip 20, only the central zone which extends on both sides of the longitudinal folding line 30 is constructed to have mirror-image symmetry, which central zone has two essentially unprofiled or uncontoured subzones which form the two folded limbs 24, 24' after folding along the longitudinal folding line 30 according to FIGS. 10 and 11, and are thus now also intended to be so designated. The strip edges 25, 25' which are arranged on both longitudinal sides of these subsequent folded limbs 24, 24' have a profile which is admittedly similar to one another, but the profiles on both sides are offset with respect to one another by a distance 33. The profiles comprise angled profile elements 29 and 29', respectively, which are located at a uniform spacing 34 with respect to one another and whose previously mentioned offset distance 33 is equal to half the spacing dimension 34 of their arrangement sequence. In order to be able to describe the subsequent folding processes better, it is useful to carry out the following breakdown of the profile elements 29, 29' on both sides.

Initially, there are narrow edge parts 26, 26', which extend transversely over the full width of the strip edges 25, 25' on both sides, each produce one angled piece of the angled profile element 29, 29', run at right angles to the longitudinal folding line 30 and, corresponding to their width, are cohesive or joined only at certain points, at 36, 36', with the longitudinal edge of the described folded limbs 24, 24'. These edge parts 26, 26' are in each case provided with axial extensions 27, 27', which extend parallel to the direction of the course of the longitudinal folding line 30. These extensions 27, 27' thus each form the other angled piece of the angled profile element 29, 29'. These profile elements 29, 29' in consequence enclose oppositely angled edge cutouts 35, 35' in the original strip 20 with the adjacent folded limbs 24, 24'.

In the course of production of the end product, namely the potential distributor 10 which can be seen in FIGS. 2 through 5, the original strip 20 is subjected to the first bending process, which can be seen in FIGS. 7 and 8. This is governed by the transverse band or kink lines designated by 37, 37' in FIG. 1, which run at right angles to the central longitudinal folding line 30 and govern the previously mentioned breakdown of the profile elements 29, 29' in the two strip edges 25, 25'. While the extensions 27 are bent upwards with respect to the associated edge part 26 in one strip edge 25, the corresponding extensions 27' located in the strip edge 25' run in the opposite direction thereto, namely pointing downwards with respect to their edge parts 26'. In this stage of the operation, only the edge parts 26, 26' remain in the plane of the original strip. The intermediate bent product 20' produced in this case has a Z-shaped cross-section, as can be seen in FIG. 8.

Figure 3:
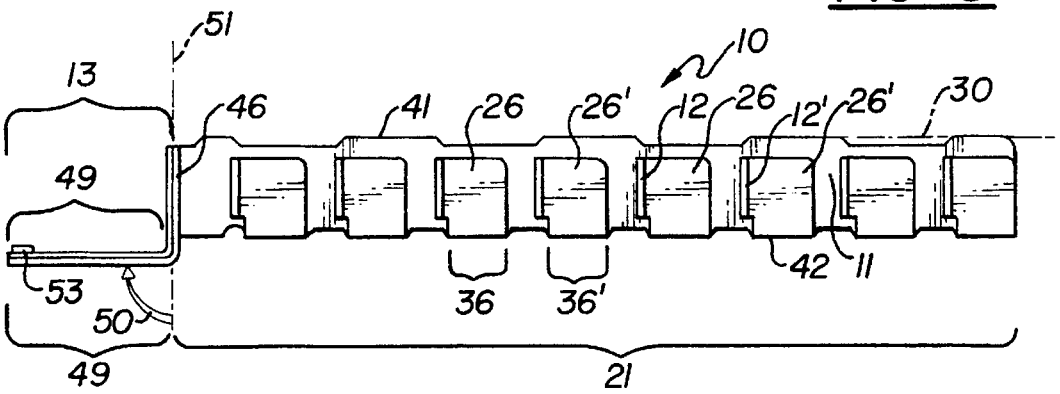
Figure 4:
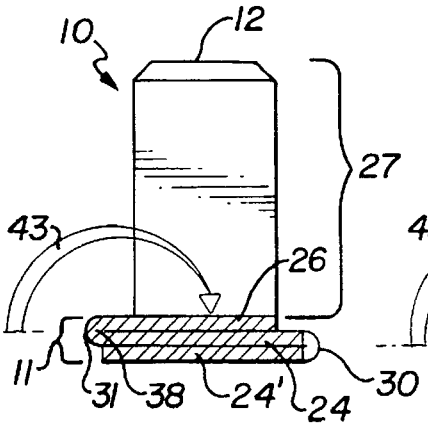
FIGS. 4 and 5 show cross-sections through the potential distributor along the section lines IV—IV and V—V indicated in FIG. 2.
Figure 5:
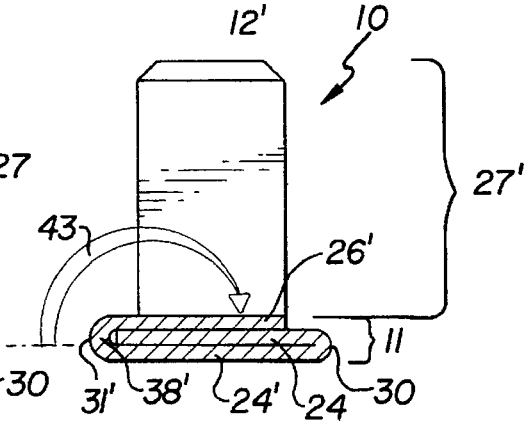

In the next operation step, according to FIGS. 9 to 11, the intermediate bent product 20' of FIGS. 7 and 8 is subjected to the already mentioned longitudinal folding along the longitudinal folding line 30, which is also indicated in FIG. 9. As can be seen from this, one strip half 22 is pressed flat against the opposite strip half 22', as has already been mentioned, and folded limbs 24, 24' which are located in the central zone of the original strip 20 come to rest one above the other. As can be seen from FIG. 10, during this longitudinal folding 40, the extensions 27, 27', which have already previously been bent, on both sides, come to rest in an aligned row on the same side of this second intermediate folded product 20" as can be seen from FIGS. 9 through 11. In this case, as a comparison with the end product 10 which can be seen in FIG. 3 shows, the longitudinal folding line 30 already governs the final first longitudinal edge 41 of the complete base rail 11. As can be seen from FIG. 9, the edge parts 26, 26' point in the same direction in the case of the second intermediate folded product 20". This also applies to the two end piece parts 28, 28', which, according to FIG. 9, are folded flat against one another in the intermediate folded product 20".

Only a common folding process of the two strip halves 22, 22', which are located flat one above the other, of the second intermediate folded product 20" is now still necessary for completion of the main section 21, which can also be seen in FIG. 3, of the complete potential distributor 10. The governing factors in this case are the folding lines 31, 31', which have already been indicated by dotted lines in the original strip 20 in FIG. 6 and run parallel to the central longitudinal folding line 30. These two parallel folding lines 31, 31' are arranged symmetrically with respect to the longitudinal folding line 30 on both sides and are thus at the same distance 32 or 32' respectively from it. Common folding of the two edge parts 26, 26', which are located one above the other according to FIG. 9, in the direction of the folding arrow 43 which can be seen in FIG. 11 now takes place. The position of these parallel folding lines 31, 31' is also indicated by dotted lines in FIG. 9.

The result can be seen from the complete potential distributor 10 according to FIGS. 2 as well as 4 and 5. The edge parts 26, 26', which are jointly bent around according to the folding arrow 43, now come to rest in the complete base rail 11, as a third layer of sheet-metal material. The course of the edge parts 26, 26' depends on their origin. According to FIG. 4, the edge part 26 is connected to the upper folded limb 24 on the parallel folding line 31 indicated on the apex side there, for which reason, in this case, three layers 24', 24, 25 are produced which are cohesive or joined in an S-shape. In the case of the cross-sectional view which can be seen in FIG. 5, the governing factor is the other parallel folding line 31', for which reason, in this case, the edge part 26' is connected to the bottom folded limb 24' and thus forms a U-shaped bracket therewith, in which the other folded limb 24 is pressed. The three layers 24, 24', 26' form, according to FIG. 5, a flattened coil with respect to one another. In consequence, in FIG. 4, a flat apex connection 38 is produced between adjacent layers 24, 26, while according to FIG. 5, at an adjacent point on the potential distributor 10, a high apex connection 38' is produced between the top layer 26' and the bottom layer 24' of the base rail 11. This special connection 38' ensures that the individual layers are pressed together in the base rail 11.

Apart from holding the three layers together in this way, and the reinforcement of the base rail 11 caused by this, the primary object of the edge parts 26, 26' is to position the flat plug tongues 12, 12', which are the governing factor. As a comparison with the second intermediate folded product 20" in FIGS. 9 to 11 shows, these flat plug tongues 12, 12' are produced by the axial extensions 27, 27', which now point upwards, of the respective edge parts 26, 26'. A common row of vertically projecting flat plug tongues 12, 12' is obtained on the top of the base rail 11 from the extensions 27, 27', which previously pointed in opposite directions. The two parallel folding lines 31, 31' according to FIGS. 4 and 5, which are located one above the other, now govern, as can be seen in FIG. 3, the second longitudinal edge 42 of the complete base rail 11, which is opposite the first longitudinal edge 41, which is produced by the longitudinal folding line 30 and has already been mentioned.

Proceeding from the second intermediate folded product 20" in FIG. 9, two banding or kinking processes also take place in the region of the end section 23 in order to produce the end piece 13, which can be seen in FIGS. 2 and 3, on the complete potential distributor 10. The governing factor for this is initially a band or kink line 44, which is indicated by dashed lines in FIGS. 6 and 9 and runs at right angles to the axially central longitudinal folding line 30, and on which the bending, which can be seen in FIG. 2, in the direction of the arrow 45 takes place. This results in an L-limb 46 for an L-shaped course to the base rail 11.

In addition, there are also the longitudinal band or kink lines 47, 47' which, as can be seen in FIGS. 6 and 9, run parallel to the axially central longitudinal folding line 30 and break the two end piece parts 28, 28' into two sections. As can be seen from FIG. 6, the central region 48, which comes to rest as an L-limb in a vertical plane in the completed product, is formed in the end section 23 between the two kink lines 47, 47' and is used to form the already described vertical L-limb 46 in FIG. 2. Located opposite on the side of these two longitudinal kink lines 47, 47' are outer areas 49, 49' which, even during the longitudinal folding in FIG. 9, come to rest one above the other in a double layer and, as a result of the movement arrow 50 in FIG. 3, are given a right-angled kink with respect to the L-limb which runs in the dashed-dotted cross-sectional plane in FIG. 3. After this longitudinal bending 50, the two outer areas 49, 49', which are flat and located one on top of the other, thus come to rest in a plane parallel to the longitudinal folding line 30, which is also shown in FIG. 3. However, as can be seen from FIG. 3, these two outer areas 49, 49' are located with a lateral offset with respect to the second longitudinal edge 42 of the complete base rail 11. This arises from the fact that, as can be seen from FIG. 6, these longitudinal kink lines 47, 47' are arranged at a grater distance 52, 52' from the longitudinal folding line 30 than that corresponding to the previously described distances 32, 32' of the two parallel folding lines 31, 31'.

The end piece 13 of the potential distributor 10 which is used for the electrical connection, is thus also completed according to FIGS. 2 and 3. The two outer areas 49, 49' can be held together by bending a small lug 53, which is inserted into a corresponding edge cutout 54 in the opposite outer area 49' and is folded around until, according to FIG. 3, it engages around the outer area 49.

For easier longitudinal folding 40, according to FIG. 10, the position of the longitudinal folding line 30 in the original strip 20 in FIG. 6 is predetermined by linear cutouts 55. Instead of this, other weak zones could also be provided in the sheet-metal material of the original strip 20, for example in the form of grooves. Such weak zones which simplify kinks and folds can, of course, also be provided in all the other folding or kink lines mentioned, but this is not necessary as a rule.

What is claimed is:

1. A potential distributor (10), especially for fuse boxes of motor vehicles, having a two-layer flat base rail (11) of sheet-metal material which has an end piece (13) for an electrical connection, and having a plurality of flat plug tongues (12,12') which project from the base rail (11) and are oriented transversely with respect to the course of the rail, which are stamped and bent out of the sheet-metal material of the two-layer flat base rail and connected in an alternating sequence either to a first layer or to a second layer of the two-layer flat base rail, wherein, the first and second layers of the base rail (11) are made from the two folded limbs (24,24') of a longitudinally folded (40), integral strip (20), having a longitudinal folding line (30) which produces a first longitudinal edge (41) of the base rail (11)

between two folded limbs (24,24') which are pressed flat against one another, the strip (20) having on its two mutually opposite strip edges (25,25') profile elements (29,29') which are arranged on alternate sides with respect to one another by means of a longitudinal offset (33), which provide a third layer (edge parts 26,26') made of sheet-metal material in the base rail (11) in certain sections (36,36') by means of further folds (43) of edge parts of the original strip (20) on two parallel folding lines (31,31') which are parallel to the longitudinal folding line (30), the third layer (edge parts 26,26') supporting the flat plug tongues (12,12').

2. The potential distributor as claimed in claim 1, wherein the longitudinal folding line (30) is arranged on the longitudinal center of the strip (20), the two parallel folding lines (31,31') are located symmetrically with respect thereto on both sides and, by means of common folding (43) of both strip edges (25,25'), produce a second longitudinal edge (42) in the base strip (20), which second longitudinal edge (42) is opposite the longitudinal folding line (30) in the strip (20) which forms the first longitudinal edge (41).

3. The potential distributor as claimed in claim 1, wherein two adjacent flat plug tongues (12,12') are produced from bends which are made in opposite directions with respect to one another, in axial extensions (27,27') of the edge parts (26,26') on both sides of the strip (20), and the kink lines (37,37') of these bends run transversely with respect to the longitudinal folding line (30).

4. The potential distributor as claimed in claim 1, wherein the edge parts (26') of the strip (20) which originate from the one folded limb (24') of the base rail (11) press the other folded limb (24) between them and the one folded limb.

5. The potential distributor as claimed in claim 1, wherein the end piece (13) has two parts (28,28') disposed in the strip halves (22,22') of the strip (20) which include the two folded limbs (24,24'), and two end piece parts (28,28') are disposed on opposite sides of the longitudinal folding line (30) (FIG. 6).

6. The potential distributor as claimed in claim 5, wherein the two end piece parts (28,28') are constructed in substantially mirror-image form with respect to one another.

7. The potential distributor as claimed in claim 5, wherein the end piece parts (28,28') are kinked jointly, both transversely (45) and longitudinally (50).

8. The potential distributor as claimed in claim 7, wherein the longitudinal kink (50) in the end piece parts (28,28') on both sides is made on two parallel kink lines (47,47') which are arranged at the same distance (52,52') from the central longitudinal folding line (30) in the original strip (20).

9. The potential distributor as claimed in claim 8, wherein the distance (52+52') between the parallel kink lines in the end piece parts (28,28') is greater than the distance (32+32') between the two parallel folding edges (31+31') of the edge parts (25,25') on both sides.

10. The potential distributor as claimed in claim 1, 2, 3, 4, 5, 6, 7, 8 or 9, wherein the position of the longitudinal folding line (30) and the positions of the two parallel folding lines (31,31') for the third layer (26,26'), and of the two parallel kink lines (47,47') in the two end piece parts (28,28') are governed by a weak zone in the strip.

11. The potential distributor as claimed in one of claim 1 2, 3, 4, 5, 6, 7, 8, or 9, characterized in that the positions of the transversely directed kink lines (37,37',44) for the flat plug tongues (12,12') and for the two end piece parts (28,28'), respectively, are governed by a weak zone in the strip.

12. The potential distributor as claimed in claim 10, wherein weak zones in the strip (20) are produced by means of cutouts in the strip (20), which cutouts (55) run in the direction of the respective folding line (30).

* * * * *